US006083023A

United States Patent [19]

Kamath

[11] Patent Number: 6,083,023

[45] Date of Patent: Jul. 4, 2000

[54] CAM ACTUATED LOW INSERTION FORCE ELECTRICAL CONNECTOR

[75] Inventor: Shashidhar M. Kamath, Belleville, Mich.

[73] Assignee: Yazaki North America, Inc., Canton, Mich.

[21] Appl. No.: 09/185,388

[22] Filed: Nov. 3, 1998

[51] Int. Cl.[7] ..... H01R 13/62

[52] U.S. Cl. ..... 439/263; 439/748

[58] Field of Search ..... 439/259, 748, 439/260, 268, 262, 263, 264, 261

[56] References Cited

U.S. PATENT DOCUMENTS

| | | | |
|---|---|---|---|
| 3,750,085 | 7/1973 | Cooper . | |
| 4,189,199 | 2/1980 | Grau . | |
| 5,573,415 | 11/1996 | Fujitani et al. | 439/260 |
| 5,735,716 | 4/1998 | Bilezikjian | 439/843 |
| 5,795,171 | 8/1998 | Bernardini | 439/260 |

*Primary Examiner*—Neil Abrams
*Assistant Examiner*—Eugene G. Bryd
*Attorney, Agent, or Firm*—Young & Basile

[57] ABSTRACT

An electrical connector assembly includes a male connector body having a set of fixed male terminals and a female connector body having a set of female terminals having flexible, parallel contact arms. A pair of clamp bars are movably mounted to a housing which is attached to the female connector body so as to position the clamp bars adjacent the respective outer surfaces of the flexible arms. Actuation pins project from opposite ends of the clamp bars to engage channels in the housing and permit movement of the bars toward one another. The ends of the pins distal from the clamp bars project beyond the opposite ends of the housing so that they may engage cam slots formed on the male connector body as the bodies are inserted into mating engagement with one another. Movement of the male and female connectors into mating engagement inserts the male terminals between the contact arms of respective female terminals with no sliding contact therebetween until the last few millimeters of travel, at which point engagement between the clamp bar pins and the cam slots forces the clamp bars toward one another to urge the contact arms into contact with the male terminals.

12 Claims, 4 Drawing Sheets

10
14
12
18a
18b
18c
22
26
36
38
44
46
54
56
62
64
66
70
72
74
82

12
18a
18b
18c
22
26
36
38
44
46
54
56
62
64
66
70
82

CAM ACTUATED LOW INSERTION FORCE ELECTRICAL CONNECTOR

FIELD OF THE INVENTION

This invention relates in general to multi-pin electrical connectors and more specifically to an electrical connector assembly in which the amount of force required to insert two mating connectors into engagement with one another is greatly reduced.

BACKGROUND OF THE INVENTION

As the number and complexity of electrical circuits in modern automobiles has increased, electrical connectors having large numbers of terminals have become more common. It is not unusual for a single electrical connector to contain 32 individual terminals. In conventional electrical connectors, the movement of a pair of connectors into engagement with one another causes male and female terminals housed in the respective connectors to slide into contact with one another. A certain degree of normal force between the terminal contact surfaces is required for good electrical conductivity between the terminals, resulting in a relatively high level of frictional resistance to insertion of the mating terminals into engagement with one another. The greater the number of terminals in a connector, the greater the total force required to overcome this resistance to insertion.

Connectors having a large number of terminals may be so difficult to mate that to do so by hand, as is often required in a production line environment, is quite difficult.

Most electrical connectors include some type of latching mechanism for holding the two connectors in mated engagement with one another. This generally takes the form of a spring latch arrangement which further adds to the amount of resistance to inserting the two connectors into engagement with one another.

This high insertion force problem has been dealt with in the past by connectors which employ a two-step connector mating operation. In such an connector, the first step involves moving the connector bodies which house the terminals into mating engagement with one another, but the male and female terminals are positioned within the bodies such that the terminals themselves do not make contact with one another. In the second step, a button, lever, or switch is actuated to move one or the other, or both, of the sets of terminals to bring them into electrical contact. This procedure has the obvious drawback of requiring two separate actions on the part of the person or machine making the connection, thus complicating and slowing down the assembly process.

It would be desirable to provide an electrical connector assembly in which first and second mating connectors may be inserted into engagement with one another without a large amount of insertion force and without requiring a secondary mating operation.

SUMMARY OF THE INVENTION

It is an object of this invention to provide a low insertion force connector assembly which can be used to advantage with connectors accommodating large numbers of terminals.

Another object of this invention is to reduce or eliminate the frictional forces between male and female terminals during mating of their respective electrical connectors.

A further object of this invention is to provide a simple, inexpensive connector mechanism for bringing terminals into electrical contact with one another without a secondary mating operation.

The invention connector assembly includes first and second connector bodies which enclose respective first and second sets of electrical terminals. The terminals of the first set are relatively fixed and rigid while the terminals of the second set are flexible. The flexible terminals have an undeflected position in which they do not make contact with respective fixed terminals, and may be bent or deflected to a second position wherein they are in contact with terminals of the first group when the first and second connector bodies are inserted into engagement with one another.

The second connector includes moveable means which is brought into contact with the flexible terminals to urge them toward the deflected position as the connector bodies are mated. The movement of the deflecting means into contact with the flexible terminals is caused by engagement with means disposed on the first connector which contacts the deflecting means and urges it toward a position which drives the flexible terminals into contact with the fixed terminals. This cam-like engagement between the deflecting means and the urging means results in contact between the fixed and flexible connectors being delayed until the last few millimeters of travel of the first and second connector bodies as they are mated, thus substantially reducing the frictional resistance resulting from contact between the terminals.

In a preferred embodiment of the invention, the flexible terminals are in the form of female terminals having first and second arms for receiving the fixed male terminals therebetween. The arms are moveable between a relatively widely spaced undeflected position and a relatively closer together deflected position wherein the inner surfaces of the arms contact opposite surfaces of respective male terminals inserted therebetween. The deflecting means comprises first and second clamp bars disposed adjacent opposite outer surfaces of the arms. The clamp bars are opposingly moveable toward one another to urge the arms of the female terminals into contact with the male terminals. The clamp bars are long enough to extend along and bracket a straight line of a large number of terminals, the clamp bars deflecting all of the terminals simultaneously as they move together.

According to a further feature of the invention, the clamp bars are movably mounted on a housing which is attached to the second connector body so as to position the clamp bars adjacent the respective outer surfaces of the flexible arms. The clamp bars are assembled with the housing and the housing is subsequently inserted into attachment with the connector body, thereby providing an easily and inexpensively manufacturable connector.

According to yet another feature of the invention, each of the clamp bars has an actuation pin projecting from its opposite ends and the pins are received by channels formed in corresponding locations on the housing thereby movably securing the clamp bars to the housing. The ends of the pins distal from the clamp bars project beyond the opposite ends of the housing so that they may engage the urging means on the first connector body as the bodies are inserted into mating engagement with one another.

According to still another feature of the invention, the urging means comprises cam surfaces disposed at opposite ends of the first connector body in positions to contact the actuation pins when the connector bodies are mated. The cam surfaces force the first and second clamp bars toward one another as the first and second connector bodies are moved the last few millimeters into engagement with one another.

According to yet another feature of the invention, cam surfaces are disposed on the first connector body which serve to urge the first and second clamp bars away from one another as the first and second connector bodies are withdrawn from engagement with one another. This provides a positive movement of the clamp bars to the open position so that the clamp bars need not depend solely on the resiliency of the flexible terminal arms to open the clamp bars as the connector bodies are disengaged. In the preferred embodiment of the invention depicted herein, the cam surfaces for urging the clamped bars inwardly and those for forcing the clamp bars outwardly are combined and take the form of first and second pairs of cam slots disposed at opposite ends of the first connector body so as to receive the respective actuator pins.

As the first and second connector bodies are inserted into mating engagement with one another, the fixed terminals are slid between the spaced apart flexible arms of the respective female terminals, and the actuator pins at the ends of the clamp bars are received by open ends of the cam slots disposed on the first connector body. Further urging of the connector bodies toward one another forces the actuation pegs further into the cam slots where the outer cam surfaces are angled inwardly, thus forcing the actuation pins and hence the clamp bars toward one another and deflecting the flexible arms of the female terminals inwardly into contact with the respective male terminals. When the first and second connector bodies are withdrawn from the mated position, the outwardly angled inner cam surfaces urge the actuation pins and hence the clamp bars away from one another so that the flexible arms of the female terminals may return to their undeflected, widely spaced positions, thus releasing the male terminals as the first and second connector bodies move away from one another.

DETAILED DESCRIPTION OF THE PREFERRED EMBODIMENT

Figure 1:
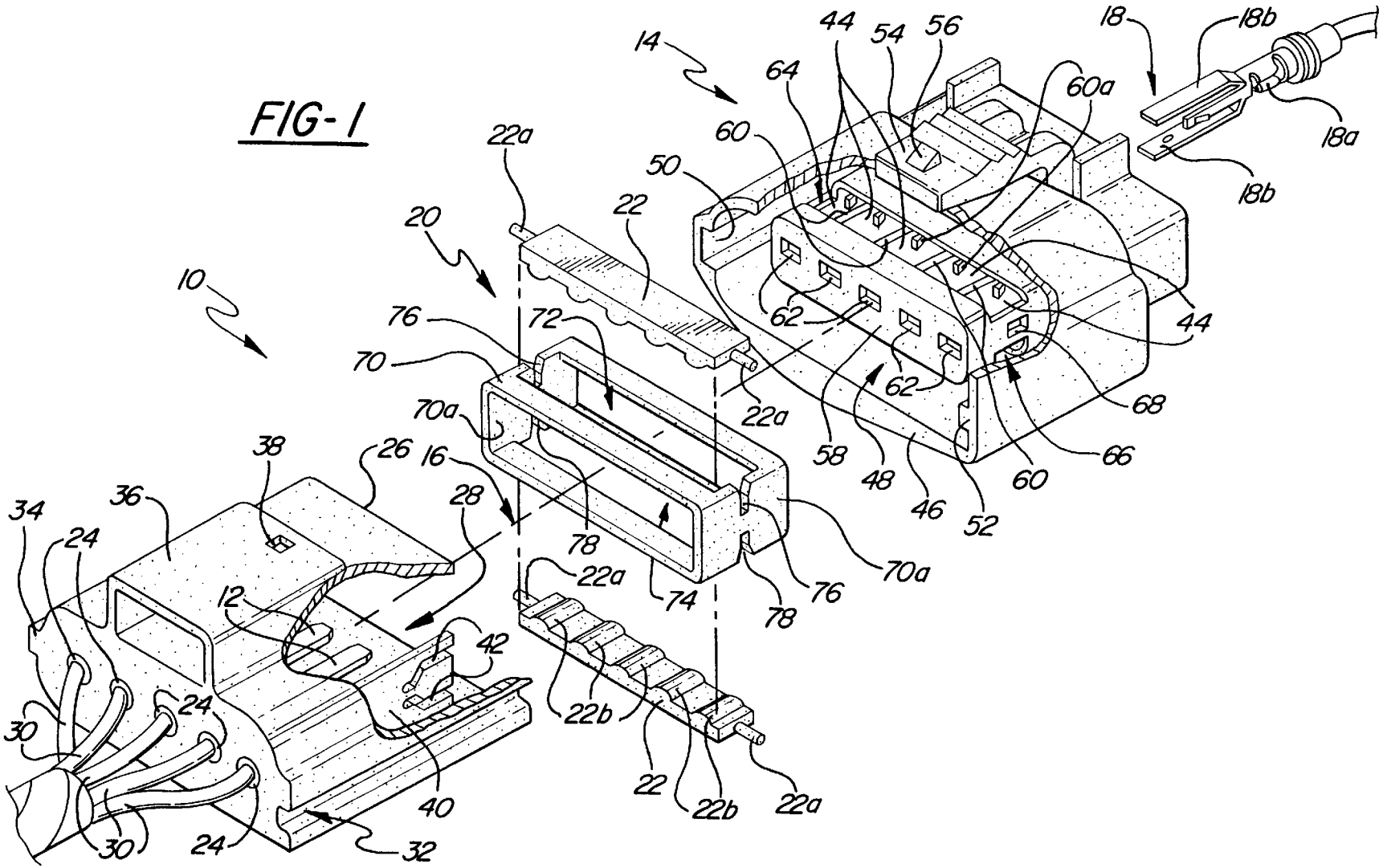
FIG. 1 is an exploded perspective view of a connector assembly according to the present invention.

As seen in the accompanying drawing figures, the connector assembly according to the present invention comprises a first male connector body 10 which houses a plurality of fixed male electrical terminals 12, a second female connector body 14 matingly engagable with the male connector body along a mating axis 16 and which houses a plurality of flexible female electrical terminals 18, and a clamping device 20 mounted within the female connector body 14 and having clamp bars 22 for urging the female terminals 18 into contact with the male terminals 12 when the male and female connector bodies are mated with one another.

The male connector body 10 is generally conventional in external configuration, having a plurality of chambers 24 at a rear end for individually receiving the male terminals 12 and an open-ended shroud 26 at the opposite, mating end which defines a hollow cavity 28. The male terminals 12 are connected to wires 30 which extend from the rear end of the connector body and are gathered together and bound into a wire harness. Flat blade portions of the male terminals 12 project into the cavity 28 and form a straight line. An alignment channel 32 is formed along one side of the male connector body 10 and an alignment ridge 34 is formed along the other, both of these features oriented along the mating axis 16 of the connector. A latch housing 36 is formed integrally with the upper surface of the male connector body 10, and has a latch hole 38 formed therein.

First and second cam plates 40 are disposed within the cavity 28 of the male connector body 10 and extend parallel to and immediately adjacent the opposite side walls thereof. Each cam plate 40 has a pair of cam slots 42 formed therein, the slots being open at the free end of the plates adjacent the mating end of the male connector body 10. The slots 42 extend parallel to the mating axis 16 of the connector a short distance into the terminal cavity 28, then angle toward one another before again extending parallel to the mating axis a short distance deeper into the cavity.

The female connector body 14 is generally conventional in exterior configuration, having a plurality of chambers 44 at a rear end for individually receiving the female terminals 18 and an open-ended shroud 46 at the opposite, mating end which defines a hollow cavity 48. The mating end of the female connector body 14 is of the proper size and shape to receive the mating end of the male connector body 10, with an alignment channel 50 and an alignment ridge 52 formed along opposite sides thereof to receive the corresponding ridge 34 and channel 32 of the male connector body 10. A latch lever 54 is formed integrally with the female connector body 14, extending upwardly and forwardly therealong, and has a pawl 56 projecting from the top surface thereof.

A terminal housing 58 is formed integrally with the female connector body 14, projecting from the rear end of the body forwardly into the cavity 48. The terminal housing 58 is hollow and its interior is subdivided by walls 60 to define the forward end of the terminal chambers 44. End holes 62 are formed in the forward end of the terminal housing 58, one communicating with each of the terminal chambers 44. Upper and lower slots 64,66 extend across the width of the terminal housing 58 adjacent to the forward end, the slots providing communication with each of the terminal chambers 44 within the housing. A lock aperture 68 is formed on either side surface of the terminal housing 58, only one of which is visible in FIG. 1.

Figure 4:
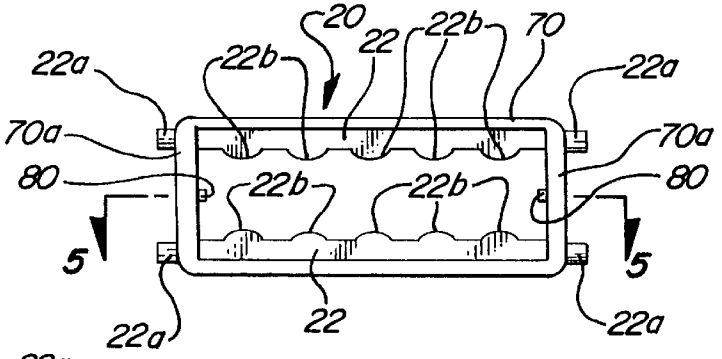
FIG. 4 is a front view of the clamping device of FIG. 3.
Figure 3:
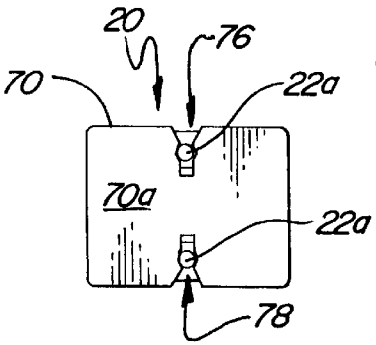
FIG. 3 is a side view of a clamping device according to the present invention.
Figure 2:
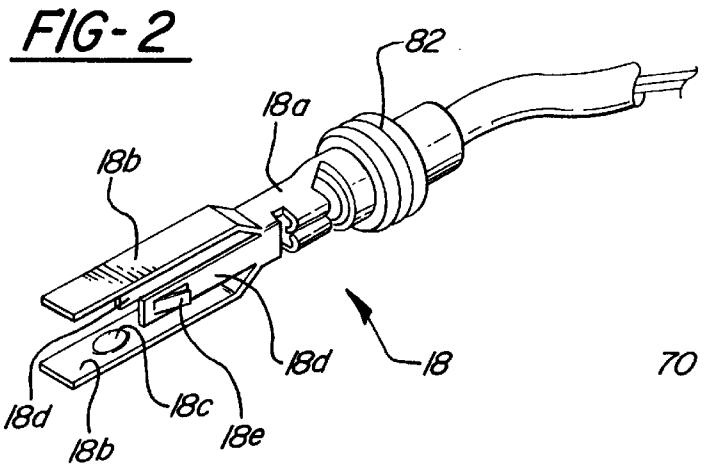
FIG. 2 is a perspective view of a female terminal as used in the present invention.
Figure 5:
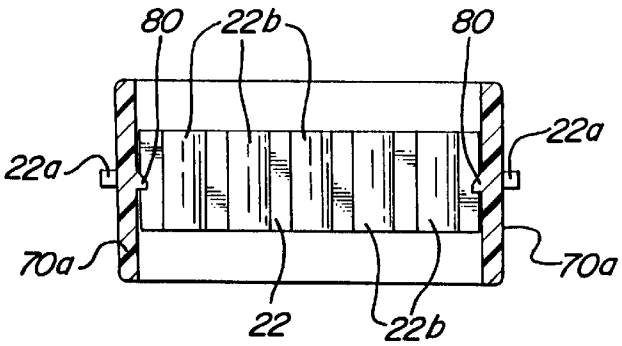
FIG. 5 is a cross-sectional view of the clamping device taken along line 5—5 of FIG. 4.

The clamping device 20 comprises a generally rectangular tube section 70 open at either end and having windows 72,74 extending the full width thereof along the upper and lower surfaces. Short channels 76 extend downwardly into the side walls 70*a* of the tube section 70 at either end of the upper window 72, and an identical pair of channels 78 extend upwardly into the side walls 70*a* at the ends of the lower window 74. As best seen in FIG. 3, each channel 76,78 has a tapered lead-in section, an adjacent circular section, and a rectangular end section. A lock projection 80 is formed on the inner surface of each side wall 70*a*, as best seen in FIGS. 4 and 5.

Upper and lower clamp bars 22 are sized to fit within the upper and lower windows 72,74 respectively. Pins 22*a* extend from either end of each clamp bar 22 which fit into the channels 76,78 in the side walls of the tube section 70. A plurality of parallel ridges 22*b* are formed on the inwardly facing surfaces of each of the clamp bars 22.

The male and female connector bodies 10,14, the tube section 70, and the clamp bars 22 are all preferably fabricated by injection molding from an electrically non-conductive plastic material such as PBT.

The female terminals 18 are preferably stamped from thin sheets of electrically conductive metal, as is well known in the art. Each female terminal comprises a crimp portion 18a for connection to an electrical wire and a pair of flexible contact arms 18*b* projecting from the crimp portion 18*a*. An electrically conductive contact bump 18*c* is disposed on the inner surface of each of the contact arms 18*b*. The contact arms 18*b* are generally parallel and spaced from one another. Two shorter locking arms 18*d* also project from the crimp portion 18*a* and have small retaining tabs 18*e* projecting outwardly therefrom adjacent their free ends. A rubber grommet 82 preferably surrounds each terminal 18 adjacent the crimp portion 18*a* to provide a degree of water-proofing when the terminal is retained in its chamber.

To prepare the connectors for mating, the female terminals 18 are inserted into respective chambers 44 from the rear end of the female connector body 14 such that the retaining tabs 18*e* on the locking arms 18*d* engage locking protrusions 60*a* formed on the surfaces of the chamber side walls 60, thereby locking the terminals in their respective chambers 44. The male terminals 12 are inserted into and retained in their chambers 24 in a similar manner. The upper clamp bar 22 is urged downwardly into the upper window 72 of the tube section 70 such that the pins 22*a* fit downwardly into their respective channels 76 in the tube section side walls 70*a*, the pins snapping into engagement with the circular sections of the channels (as seen in FIG. 3) to retain the clamp bar 22 in connection with the tube section 70. The pins 22*a* are sufficiently long to project outwardly beyond the tube section side walls 70*a* by a short distance. The lower clamp bar 22 is inserted into the lower window 74 in an identical manner, and the pins 22*a* also project outwardly beyond the tube section side walls 70*a*.

Figure 6:
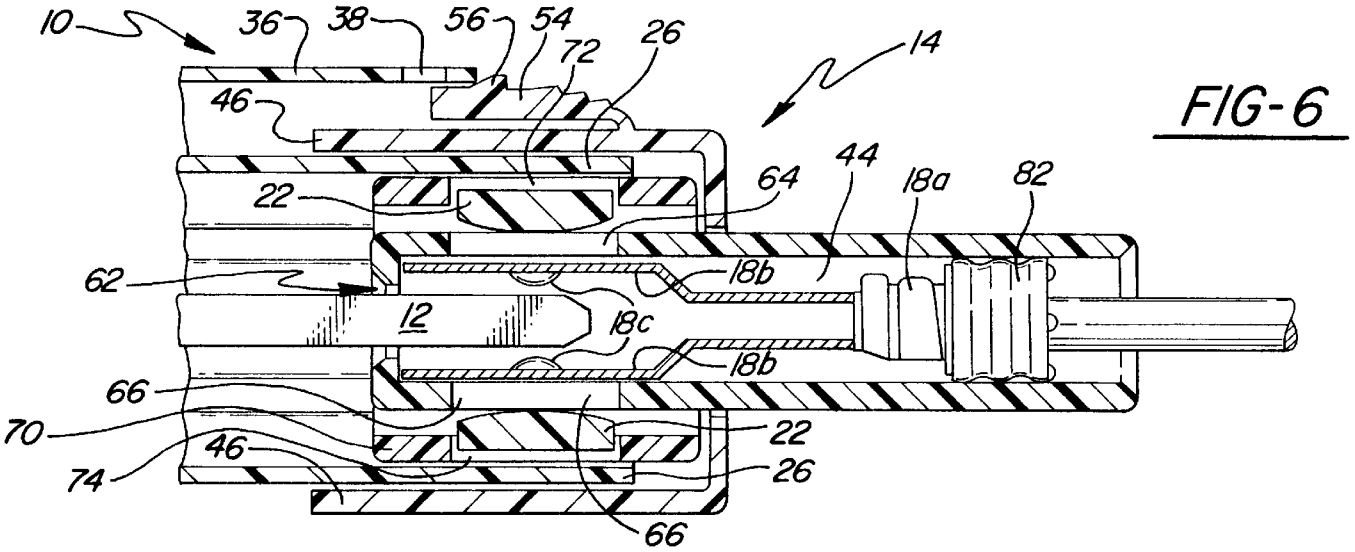
FIG. 6 is a cross-sectional view of the connector assembly with the male and female connector bodies just short of full mated engagement.

The tube section 70, along with the captive clamp bars 22, is then inserted into the mating end of the female connector body 14 such that the open end of the tube section 70 fits over the terminal housing 58. The tube section 70 is slid over the terminal housing 58 until the upper and lower clamp bars 22 are aligned with respective upper and lower slots 64,66 in the terminal housing 58 (see FIG. 6), at which point the lock projections 80 on the inner surfaces of the tube section side walls 70*a* engage the lock apertures 68 formed in the side walls of the terminal housing to retain the tube section in position.

The male and female connector bodies 10,14 are then ready to be mated with one another. As the two connector bodies are slid into engagement along the mating axis 16, the male terminals 12 project through the respective end holes 62 in the terminal housing 58 and between the contact arms 18*b* of the respective female terminals 18. The contact arms 18*b* are spaced far enough apart to receive the male terminal blades therebetween without any sliding contact between them. Also as the male and female connector bodies are slid into engagement with one another, the latch lever 54 on the female connector body 14 passes into the latch housing 36 of the male connector body 10 and is initially deflected downward slightly by contact between the pawl 56 and the front edge of the latch housing 36.

Figure 7:
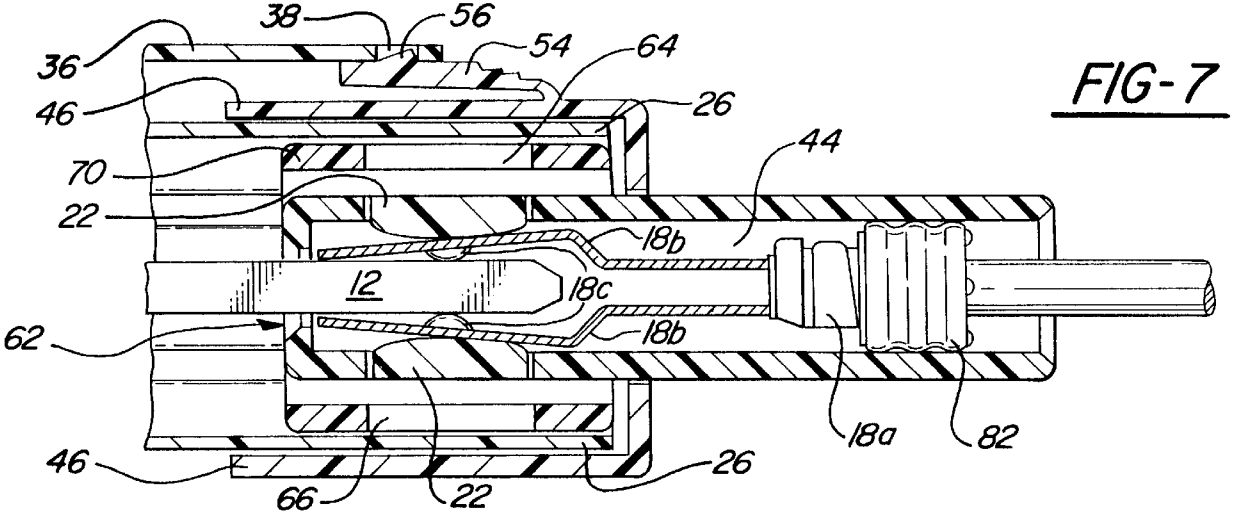
FIG. 7 is a cross-sectional view of similar to that of FIG. 6, but with the male and female connector bodies in full mated engagement.
Figure 8:
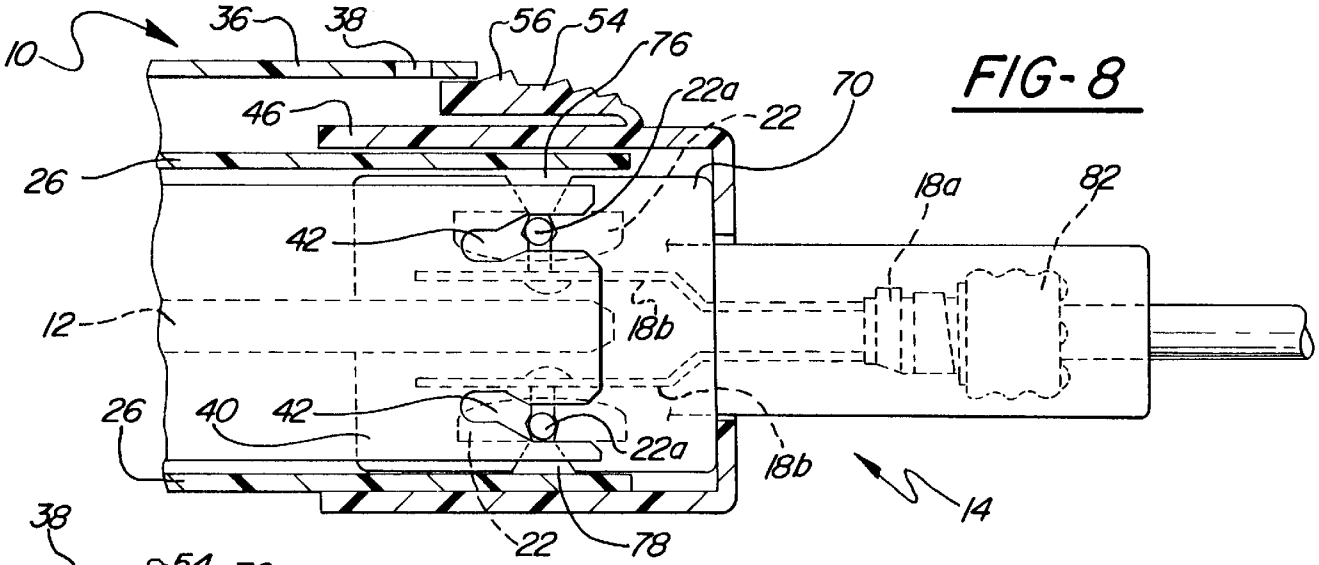
FIG. 8 is a cross-sectional view of the connector assembly taken between a side wall and a cam plate of the male connector body, with the male and female connector bodies just short of full mated engagement.
Figure 9:
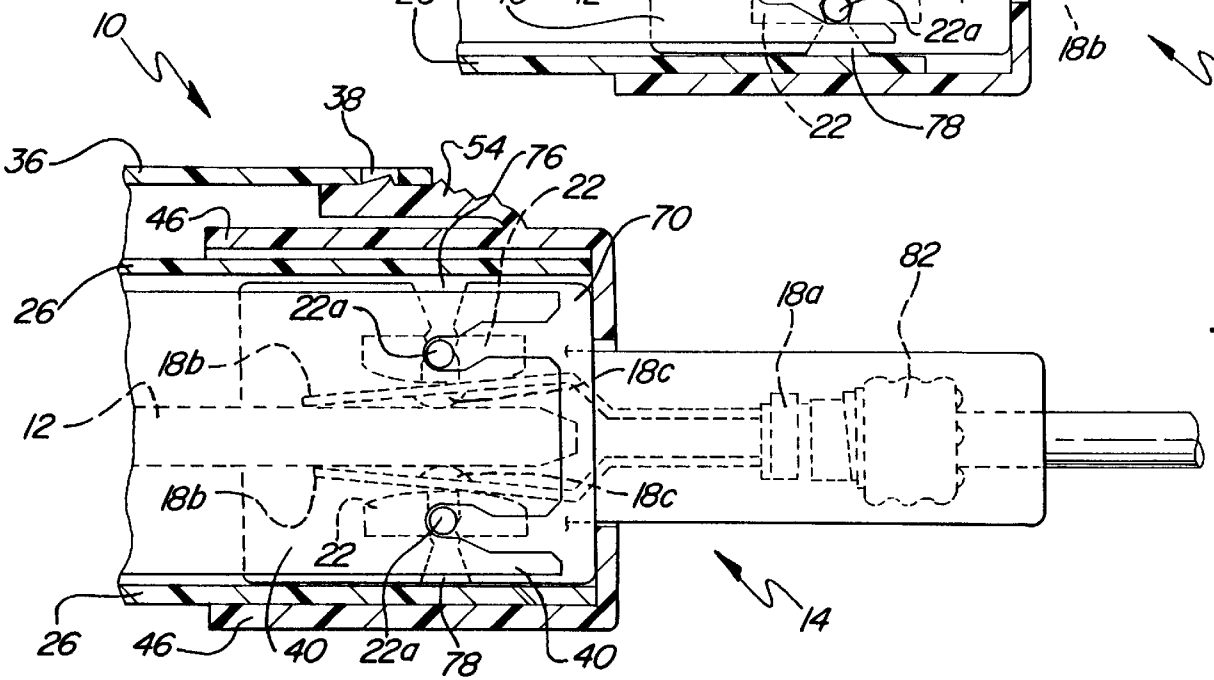
FIG. 9 is a cross-sectional view similar to that of FIG. 8, but with the male and female connector bodies in full mated engagement.

Also as the male connector body 10 is slid into the female connector body 14, the ends of the clamp bar pins 22*a* projecting outwardly beyond the side walls of the tube section 70 are received by the open ends of the cam slots 42 and slide freely into the slots until the pins 22*a* reach the inwardly angled portions of the cam slots 42, as seen in FIG. 8. Further urging of the male connector body 10 into the female connector body 14 causes the pins 22*a* to travel along the inwardly angled portions of their respective slots, thereby forcing the clamp bars 22 toward one another so that they pass through the respective upper and lower slots 64,66 in the female terminal housing 58 and press against the outer surfaces of the female terminal contact arms 18*b* to deflect the contact arms inwardly into contact with the male terminals 12. The contact bump 18*c* on the inner surface of each of the contact arms 18*b* creates a point of concentrated normal force between the male and female terminals 12,18 (as best seen in FIG. 7) thereby helping to achieve good electrical contact between the terminals.

At this point of full insertion of the male connector body 10 into the female connector body 14, the pawl 56 comes into alignment with the latch hole 38 and the latch lever 54 snaps upwardly so that the male and female connector bodies are latched together.

To disengage the male and female connector bodies, the latch lever 54 is depressed to release the pawl 56 from the latch hole 38 and the two connector bodies are pulled away from one another. As the clamp bar pins 22*a* are drawn outwardly along the angled sections of the cam slots 42, the clamp bars 22 are urged away from one another until the pins 22*a* are once again retained in the circular sections of the channels 76 and 78, thus allowing the flexible terminal arms to release contact with the male terminals and return to their undeflected positions.

As is apparent the foregoing description, the present invention reduces the amount of insertion force required to mate the two connector bodies because there is no sliding contact between the male and female terminals as the connector bodies are slid into engagement with one another and therefore there is no frictional force to overcome during the mating procedure. In addition, no separate, second actuation step is required to bring the male and female connectors into contact with one another.

Figure 10:
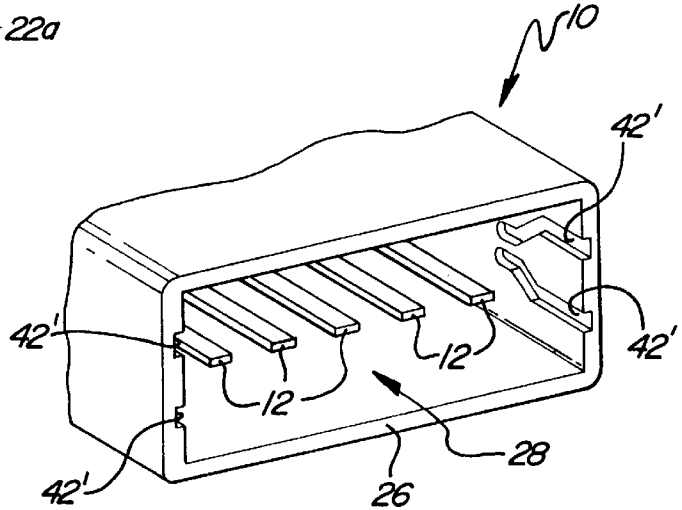
FIG. 10 is a perspective view of an alternative embodiment of a male connector body according to the present invention.

In an alternative embodiment of the invention shown in FIG. 10, the male connector body 10' does not include cam plates 40. Rather, the cam slots 42' are formed in the inner surfaces of the side walls of the male connector body 10'.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An electrical connector assembly comprising:

a first connector body having a plurality of first terminals disposed therein;

a second connector body matingly engageable with the first connector body;

a plurality of flexible terminals disposed in the second connector body, each of the flexible terminals comprising first and second spaced-apart, flexible arms opposingly movable between (a) undeflected positions wherein they are spaced relatively far apart to receive respective first terminals therebetween, and (b) deflected positions wherein the arms are relatively close together such that inner surfaces of the arms contact the respective first terminals when the first and second connector bodies are placed in mating engagement with one another;

means disposed on the second connector body adjacent outer surfaces of respective first and second arms for deflecting the flexible terminals, the deflecting means movable with respect to the second connector body between (a) a contact position wherein the deflecting means contacts opposite outer surfaces of the flexible arms to urge the arms to the deflected positions, and (b) an open position wherein the deflecting means allows the flexible arms to assume the undeflected positions; and means disposed on the first connector for urging the deflecting means from the open position to the contact position as the first and second connector bodies are inserted into mated engagement with one another.

2. The electrical connector according to claim 1 wherein the deflecting means comprises first and second clamp bars disposed adjacent opposite outer surfaces of the first and second arms respectively, the clamp bars being opposingly movable toward one another to the contact position and away from one another to the open position.

3. The electrical connector assembly according to claim 2 wherein the deflecting means further comprises a mounting member to which the clamp bars are attached for movement between the contact and open positions, the mounting member being attached to the second connector body to position the first and second clamp bars adjacent the outer surfaces of the first and second terminal arms respectively.

4. The electrical connector assembly according to claim 3 wherein at least one of the clamp bars has first and second actuation pins projecting from opposite ends thereof movably retained in first and second channels formed in the mounting member at opposite ends thereof, and ends of the pins distal from the clamp bar projecting beyond the opposite ends of the mounting member for engagement with the urging means.

5. The electrical connector assembly according to claim 4 wherein the means for urging the deflecting means to the contact position comprises first and second cam surfaces disposed at opposite sides of the first connector body to engage respective first and second actuation pins as the first and second connector bodies are inserted into mated engagement with one another.

6. The electrical connector assembly according to claim 1 further comprising means disposed on the first connector body for urging the deflecting means from the contact position to the open position as the first and second connector bodies are withdrawn from mated engagement with one another.

7. The electrical connector assembly according to claim 6 wherein the means for urging the deflecting means to the contact position comprises at least one first cam surface and the means for urging the deflecting means to the open position comprises at least one second cam surface, the first and second cam surfaces defining therebetween a cam slot for receiving a portion of the deflecting means as the first and second connector bodies are inserted into mated engagement with one another.

8. The electrical connector assembly according to claim 7 wherein the deflecting means comprises at least one clamp bar having first and second actuation pins projecting from opposite ends thereof, the actuation pins being received in first and second cam slots disposed at opposite sides of the first connector.

9. The electrical connector assembly according to claim 8 wherein the first and second cam slots are formed in first and second plates respectively.

10. An electrical connector assembly comprising:

a first connector body having a plurality of first terminals disposed therein;

a second connector body matingly engageable with the first connector body;

a plurality of second terminals disposed in the second connector body, each terminal comprising first and second flexible arms opposingly movable between (a) an undeflected position wherein the arms are relatively far apart, and (b) a deflected position wherein the arms are relatively close together and inner surfaces of the arms contact respective first terminals when the first and second connector bodies are placed in mating engagement with one another such that the first terminals are inserted between the arms of respective second terminals;

first and second clamp bars disposed on the second connector body adjacent outer surfaces of respective first and second arms and opposingly movable with respect to the second connector body between a contact position wherein the clamp bars are relatively close together to urge the terminal arms to the deflected position and an open position wherein the clamp bars are relatively far apart to allow the terminal arms to assume the undeflected position; and first and second cam slots disposed on the first connector body for receiving portions of the first and second clamp bars respectively, engagement between the cam slots and respective clamp bars urging the clamp bars from the open position to the contact position as the first and second connector bodies are inserted into mated engagement with one another and urging the clamp bars from the contact position to the open position as the first and second connector bodies are withdrawn from mated engagement with one another.

11. The electrical connector assembly according to claim 10 further comprising a mounting member to which the clamp bars are attached for movement between the contact and open positions, the mounting member being attached to the second connector body to position the clamp bars adjacent the respective outer surfaces of the terminal arms.

12. The electrical connector assembly according to claim 11 wherein each of the clamp bars has first and second actuation pins projecting from opposite ends thereof movably retained in first and second channels formed in the mounting member at opposite ends thereof, and ends of the pins distal from the clamp bar project beyond the opposite ends of the mounting member for engagement with the cam slots.

* * * * *